US005358161A

United States Patent [19]

Perugini

[11] Patent Number: 5,358,161

[45] Date of Patent: Oct. 25, 1994

[54] BELT MOUNTED SPACKLE PAN HOLDER

[76] Inventor: Rocco Perugini, P.O. Box 566, Hazelton, Pa. 18201-0566

[21] Appl. No.: 72,960

[22] Filed: Jun. 8, 1993

[51] Int. Cl.[5] ..... A45F 5/00

[52] U.S. Cl. ..... 224/252; 224/904; 224/148; 224/242

[58] Field of Search ..... 224/252, 904, 225, 226, 224/242, 148

[56] References Cited

U.S. PATENT DOCUMENTS

| | | | |
|---|---|---|---|
| 1,109,161 | 9/1914 | Chindgren . | |
| 4,319,704 | 3/1982 | Rosen . | |
| 4,457,462 | 7/1984 | Taormina . | |
| 4,746,042 | 5/1988 | King | 224/148 |
| 4,936,499 | 6/1990 | Gulley . | |
| 4,951,857 | 8/1990 | Carr . | |
| 5,016,791 | 5/1991 | Burow | 224/148 |
| 5,072,868 | 12/1991 | Dickie et al. | 224/252 |
| 5,176,302 | 1/1993 | Smith . | |
| 5,181,637 | 1/1993 | Santilli . | |

*Primary Examiner*—Ernest G. Cusick
*Attorney, Agent, or Firm*—Richard C. Litman

[57] ABSTRACT

A spackle pall holder for holding a spackle pan having a closed bottom end, an open top end, and inclined peripheral walls. The holder is an open top holder having inclined peripheral walls, a bottom wall, and a clip assembly located on one of the inclined peripheral walls of the holder adjacent to the open top. The clip assembly enables the holder to be detachably attached to the belt of a person. The clip should be large enough and of suitable construction to ensure that the weight of the holder, the pan, and the spackle compound contained within the pan are adequately secured to the belt. The holder has a shape approximating that of the spackle pan to provide a frictional engagement therebetween. Alteratively, the inclination of the peripheral walls of the spackle pan is greater than that of the side walls of the holder to substantially eliminate friction therebetween. Preferably, the peripheral walls of the holder are provided with openings to ensure that a spackle pan is used in combination with the holder and that the holder is not used in substitution of a spackle pan. The pan, upon engagement with the holder, extends approximately one inch above the top of the holder to enable the user to easily grasp and remove the pan therefrom.

6 Claims, 2 Drawing Sheets

10
40
44
46
44
46
24
32
22
26
30
32
22
20
24

BELT MOUNTED SPACKLE PAN HOLDER

BACKGROUND OF THE INVENTION

1. Field of the Invention

The present invention relates to an article carrier and, more particularly, to a spackle pan holder having a clip or hook for attaching the holder to the belt of a user.

2. Description of the Prior Art

When finishing drywall, seams between the individual sheets of drywall are taped and spackled, and the nail heads or drywall screws are spackled to conceal the joints and the nails or screws. During the course of finishing the drywall, a drywall finisher is required to tape both wall and ceiling joints. This requires the finisher to have one hand free to manipulate the tape and the other hand free to control the blade used to apply the spackling compound. A spackling pan holds a desired amount of spackling compound and may be easily carried while spackling nails or screws. When spackling nails or screws, tape is not applied. One hand is free to carry the blade and the other hand is free to carry the pan. However, when taping joints, both hands need to be free to apply both the tape and the compound. A holder which would permit a spackle pan to be attached to the body of a person would free both hands of the finisher to permit the finisher to tape seams or joints with relative ease.

Holders attachable to the body of a user are well known. One such holder is shown, for example, in U.S. Pat. No. 1,109,161, issued Sep. 1, 1914 to Gustaf Chindgren who discloses a paint can holder having a trough shaped receptacle and an inwardly curved shield attached to the trough shaped receptacle. A strap and buckle fasten to the shield to fasten the receptacle around the waist of the user. Another holder or the like is shown in U.S. Pat. No. 4,319,704, issued Mar. 16, 1982 to Louis M. Rosen. Rosen discloses a support member having a flat extension support surface and a slotted portion adapted to receive a user's belt. Yet another holder is shown in U.S. Pat. No. 4,457,462, issued Jul. 3, 1984 to Umberto C. Taormina, which discloses a tool holder formed of a length of wire material. A tool carrier is disclosed in U.S. Pat. No. 4,936,499, issued Jun. 26, 1990 to James L. Gulley. The tool carrier comprises a frame formed of a closed loop of wire. The frame is adapted to receive a receptacle. The receptacle includes a peripheral groove configured for engagement with the frame. U.S. Pat. No. 4,951,857, issued Aug. 28, 1990 to Michael Carr, discloses a paint brush carrier having a flat member pivotally connected to a pocket clip and a removable paint brush container. A belt mounted can holder is described in U.S. Pat. No. 5,176,302, issued Jan. 5, 1993 to Edwin Smith. The can holder is intended to support a paint can having a wire-like handle. The holder is formed of a single substantially rigid, elongated, continuous wire-like member. Another patent of interest is U.S. Pat. No. 5,181,637, issued Jan. 26, 1993 to Joseph Santilli who discloses a combination nail bag and open top container. The container is provided with three peripheral walls and a bottom. The rear of the container is provided with an opening having a neck portion thereabout to which the nail bag is connected.

None of the above inventions and patents, taken either singly or in combination, is seen to describe the instant invention as claimed.

SUMMARY OF THE INVENTION

The present invention is a spackle pan holder for holding a spackle pan. The spackle pan has a closed bottom end, an open top end, and inclined peripheral walls. The holder is an open top holder having inclined peripheral walls and a bottom wall. A clip assembly is located on one of the inclined peripheral walls of the holder adjacent to the open top. The clip is purposed for detachably attaching the combination structure to the belt of a person. The clip should be large enough and of suitable construction to ensure that the weight of the holder, the pan, and the spackle compound contained within the pan are adequately secured to the belt. The holder has a shape approximating that of the spackle pan to provide a frictional engagement between the two. Alteratively, the inclination of the peripheral walls of the spackle pan is greater than that of the side walls of the holder to substantially eliminate friction therebetween. Preferably, the peripheral walls of the holder are provided with openings to ensure that a spackle pan is used in combination with the holder and that the holder is not used in substitution of a spackle pan. The pan, upon engagement with the holder, extends approximately one inch above the top of the holder to enable the user to easily grasp and remove the pan therefrom. The holder is formed of a material which is substantially rigid, such as metal.

Accordingly, it is a principal object of the invention to provide a spackle pan holder for holding a spackle pan having closed bottom end, an open top end, and inclined peripheral walls, wherein the holder is an open top holder having inclined peripheral walls, a bottom wall, and a clip assembly for detachably attaching the combination structure to the body of a person.

It is another object that the holder have a shape approximating that of the spackle pan to provide a frictional engagement between the two.

It is a further object that, as an alternative, the inclination of the peripheral walls of the spackle pan is greater than that of the side walls of the holder to substantially eliminate friction therebetween.

Still another object is that the peripheral walls of the holder be of an open construction to ensure that a spackle pan is used in combination with the holder and that the holder is not used in substitution of a spackle pan.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
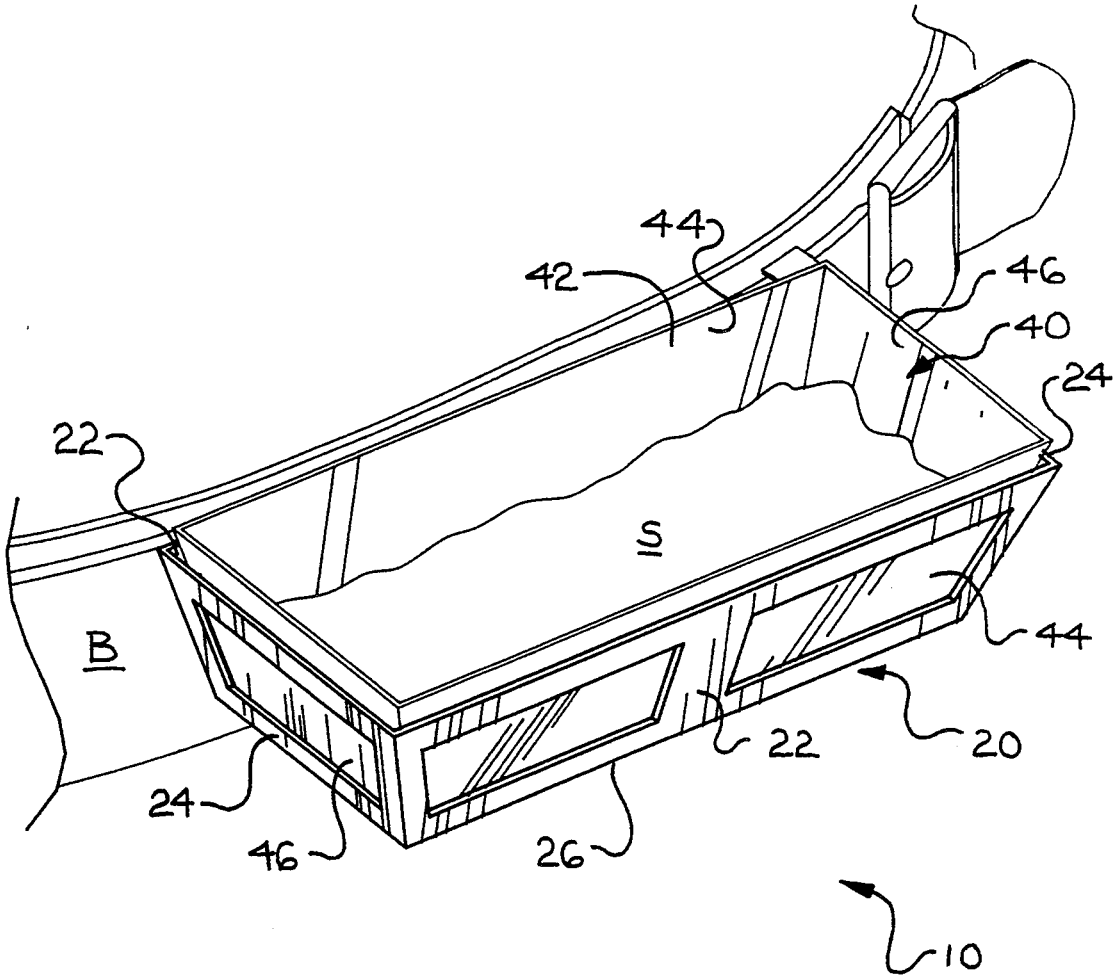
FIG. 1 is a front environmental perspective view of a belt mounted spackle pan according to the present invention.
Figure 2:
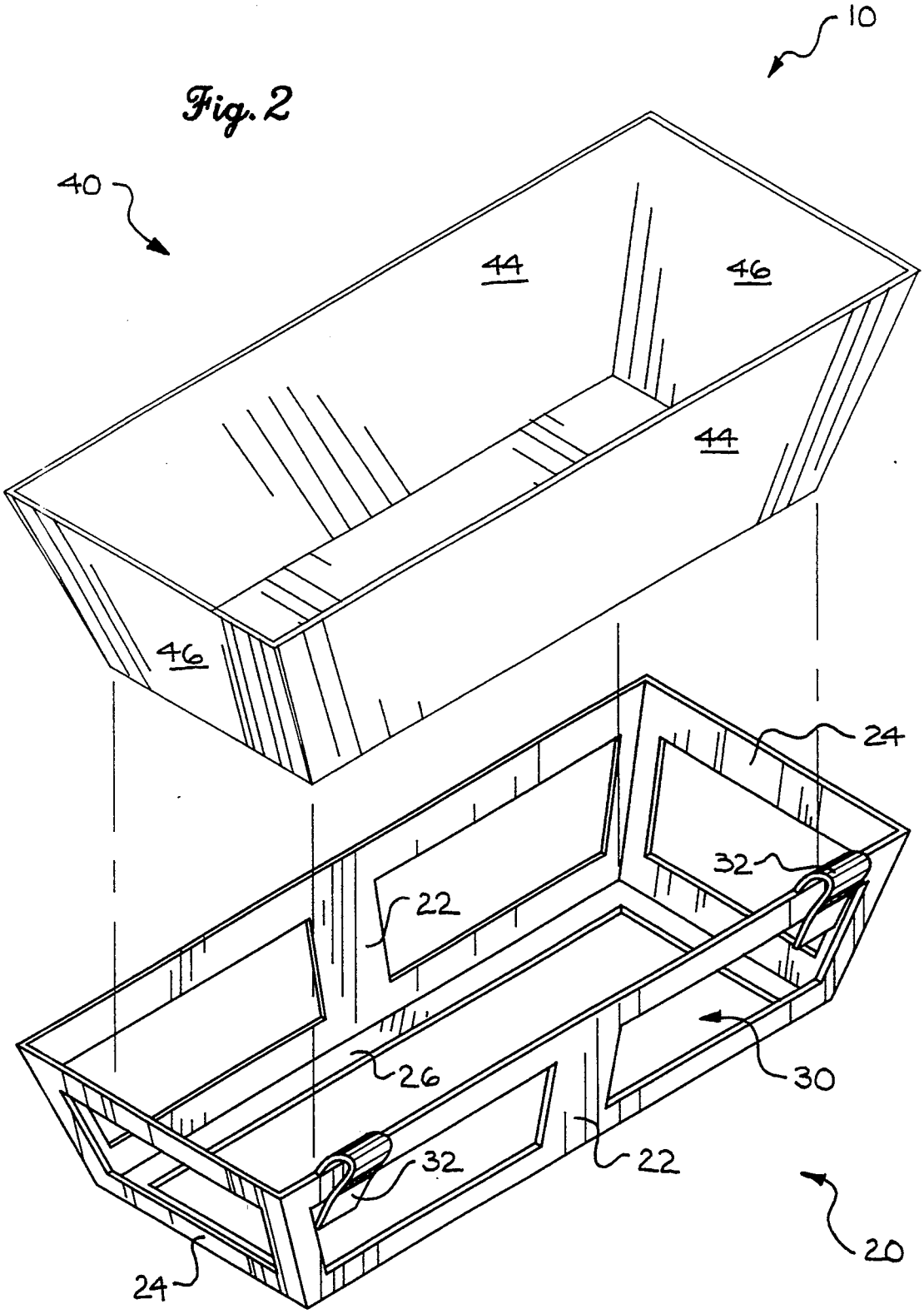
FIG. 2 is an exploded rear perspective view of the belt mounted spackle pan shown in FIG. 1.

The present invention, as shown in FIGS. 1 and 2, is a carrier or holder 20 for holding a spackle pan 40 and, more particularly, a combination spackle pan and spackle pan holder assembly 10 securable to the body of a person (not shown). The holder 20 is suitable for engagement with a person's belt B.

Referring more specifically to FIG. 2, the holder 20 is comprised of an open top frame formed of inclined peripheral walls 22 and 24, and a bottom wall 26. A spackle pan insertion portion is bounded by the inclined peripheral walls 22 and 24. Preferably, the peripheral walls 22 and 24 of the holder 20 are provided with openings to ensure that a spackle pan 40 is used in combination with the holder 20 and that the holder 20 is not used in substitution of or without a spackle pan 40. The pan 40, upon engagement with the holder 20, extends approximately one inch the top of the holder 20 to enable the user (not shown) to easily grasp and remove the pan 40 therefrom. It is suggested that an opening be provided in the bottom wall 26 of the holder 20, whereby a finger may be inserted to assist in urging the spackle pan 40 out of the holder 20. The holder 20 should be formed of a material which is substantially rigid, such as plastic or metal, and preferably carbon steel.

The spackle pan 40 includes an open top end 42, inclined peripheral walls 44 and 46, and a closed bottom end 48. The spackle pan 40 has a shape approximating the shape of the holder 20 to provide a frictional engagement between the spackle pan 40 and the holder 20. Alternatively, the inclination of the peripheral walls 44 and 46 of the spackle pan 40 may be greater than the inclination of the peripheral walls 22 and 24 of the holder 20 to reduce the frictional engagement between the same. These two embodiments would accommodate both users who prefer a secure grip of the spackling pan 40 by the holder 20, and those desiring ready disengagement. Spackling compound S, as shogun in the spackle pan 40 in FIG. 1, is a dense material, and the weight of the same will assist in maintaining the spackle pan 40 in engagement with the holder 20.

The holder 20 includes a belt supporting portion or clip assembly 30 including two spaced apart hooks or clips 32 for slidably engaging a belt B of a person. The hooks or clips 32 are located on one of the peripheral walls 22 adjacent the open top end of the holder 20. The hooks or clips 32 are arranged in a substantially spaced parallel fashion to enhance the stability of the belt supporting portion. The hooks or clip 32 should be large enough and of suitable construction to ensure that the weight of the holder 20, the pan 40, and the spackle S compound contained within the pan 40 are adequately secured to the belt B.

As shown in FIG. 1, in use, the spackle pan 40 is removably secured in the spackle pan insertion portion of the holder 20 between the inclined peripheral walls 22 and 24 of the holder 20. The spackle pan 40 is filled with a desired amount of spackling compound S and is then clipped on the belt B of the user. The holder 20 would permit the user to move freely about a work area with his hands free to tape and spackle seams between wall boards.

It is to be understood that the present invention is not limited to the sole embodiment described above, but encompasses any and all embodiments within the scope of the following claims.

I claim:

1. A combination spackle pan and spackle pan holder assembly comprising:

a spackle pan having a closed bottom end, an open top end, and inclined peripheral walls;

an open top holder having inclined peripheral walls; and a clip assembly on one of said inclined peripheral walls of said open top holder adjacent said open top for detachably attaching said combination structure to the belt of a person.

2. The assembly according to claim 1, wherein the inclination of the peripheral walls of the spackle pan is greater than that of said side walls of said holder.

3. The assembly according to claim 1, wherein said holder has a shape approximating that of the spackle pan.

4. The assembly according to claim 1, wherein said peripheral walls of said holder are foraminous.

5. The assembly according to claim 1, wherein said holder is formed of a material which is substantially rigid.

6. The assembly according to claim 5, wherein said material is metal.

* * * * *